US010456820B2

(12) United States Patent
Nakamura et al.

(10) Patent No.: US 10,456,820 B2
(45) Date of Patent: Oct. 29, 2019

(54) METHOD FOR MANUFACTURING MOLDED MEMBER

(71) Applicant: Nisshin Steel Co. Ltd., Tokyo (JP)

(72) Inventors: Naofumi Nakamura, Tokyo (JP); Yudai Yamamoto, Tokyo (JP)

(73) Assignee: Nippon Steel Nisshin Co., Ltd., Tokyo (JP)

( * ) Notice: Subject to any disclaimer, the term of this patent is extended or adjusted under 35 U.S.C. 154(b) by 0 days.

(21) Appl. No.: 16/079,555

(22) PCT Filed: Mar. 2, 2017

(86) PCT No.: PCT/JP2017/008362
§ 371 (c)(1),
(2) Date: Aug. 23, 2018

(87) PCT Pub. No.: WO2017/150690
PCT Pub. Date: Sep. 8, 2017

(65) Prior Publication Data

US 2019/0054515 A1 Feb. 21, 2019

(30) Foreign Application Priority Data

Mar. 3, 2016 (JP) ..... 2016-040551

(51) Int. Cl.
*B21D 22/28* (2006.01)
*B21D 22/30* (2006.01)
(Continued)

(52) U.S. Cl.
CPC ..... *B21D 22/28* (2013.01); *B21D 22/206* (2013.01); *B21D 22/30* (2013.01); *B21D 24/12* (2013.01)

(58) Field of Classification Search
CPC ..... B21D 22/28; B21D 22/26; B21D 22/30; B21D 24/14; B21D 24/005; B21D 24/02; B21D 24/06; B21D 24/08; B21D 24/00
See application file for complete search history.

(56) References Cited

U.S. PATENT DOCUMENTS 4,263,800 A * 4/1981 Arfert ..... B21D 22/28 72/349
5,687,598 A * 11/1997 Kirii ..... B21D 24/14 72/21.5
(Continued)

FOREIGN PATENT DOCUMENTS

EP 0572016 12/1993
EP 0715908 6/1996
(Continued)

OTHER PUBLICATIONS

English translation of the International Preliminary Report on Patentability, counterpart International Appl. No. PCT/JP2017/008362, dated Sep. 13, 2018 (8 pages).
(Continued)

*Primary Examiner* — Pradeep C Battula
(74) *Attorney, Agent, or Firm* — Cook Alex Ltd.

(57) ABSTRACT

A method for manufacturing a molded member is provided wherein the base metal sheet is subjected to multi-stage drawing to manufacture the molded member, including a tubular body and a flange formed at an end portion of the body. The multi-stage drawing includes: preliminary drawing for forming a preliminary body having a body element from the base metal sheet; at least one compression drawing performed after the preliminary drawing and forming the body by drawing the body element while applying a compressive force to the body element; and at least one finishing ironing performed after the at least one compression drawing.

4 Claims, 11 Drawing Sheets

(51) Int. Cl.
*B21D 22/20* (2006.01)
*B21D 24/12* (2006.01)

(56) References Cited

U.S. PATENT DOCUMENTS

| | | | | |
|---|---|---|---|---|
| 9,901,970 | B2 * | 2/2018 | Nakamura | B21D 22/30 |
| 2016/0001349 | A1 | 1/2016 | Nakamura et al. | |
| 2016/0144418 | A1 | 5/2016 | Nakamura et al. | |
| 2017/0128998 | A1 * | 5/2017 | Nakamura | B21D 22/28 |
| 2018/0099325 | A1 * | 4/2018 | Nakamura | B21D 22/28 |

FOREIGN PATENT DOCUMENTS

| | | | | |
|---|---|---|---|---|
| EP | 3278898 | | 2/2018 | |
| JP | 49-028538 | | 3/1974 | |
| JP | 04-043415 | | 4/1992 | |
| JP | 11-226661 | | 8/1999 | |
| JP | 2013-051765 | | 3/2013 | |
| JP | 5395301 | | 1/2014 | |
| JP | 5600821 | B1 * | 10/2014 | B21C 1/22 |
| JP | 2016-000427 | | 1/2016 | |
| JP | 6352539 | | 7/2018 | |
| TW | 201544207 | * | 1/2015 | |
| TW | 201641178 | A * | 12/2016 | |
| WO | WO 03/035298 | | 5/2003 | |
| WO | WO 2015/190125 | | 12/2015 | |

OTHER PUBLICATIONS

Murakawa et al., Basic of Plastic Processing, First Edition, Sangyo-Tosho Publishing Co, Ltd., pp. 104-107, with English translation (Jan. 16, 1990) (12 pages).

International Search Report and Written Opinion, counterpart International Appl. No. PCT/JP2017/008362, with partial English translation (dated May 9, 2017) (9 pages).

Notification of Reasons for Refusal, counterpart Japanese App. No. 2017-524061, with English translation (dated Feb. 7, 2018) (7 pages).

Decision to Grant a Patent, counterpart Japanese App. No. 2017-524061, with English translation (dated Apr. 23, 2018) (6 pages).

Extended European Search Report, counterpart EP App. No. 17760153 (dated Apr. 8, 2019) (9 pages).

* cited by examiner

[FIG. 1]
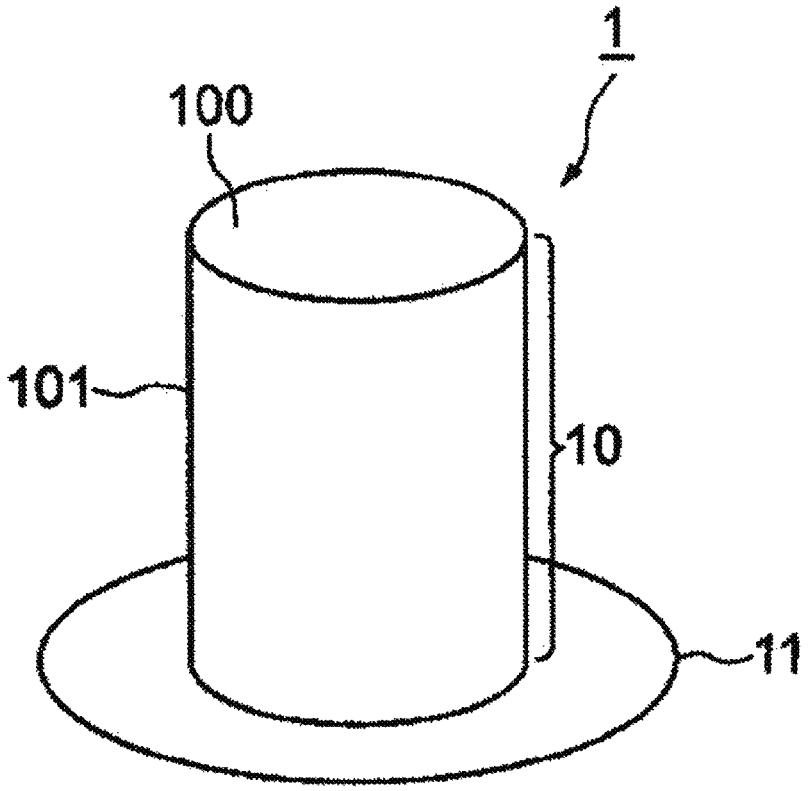

[FIG. 2]
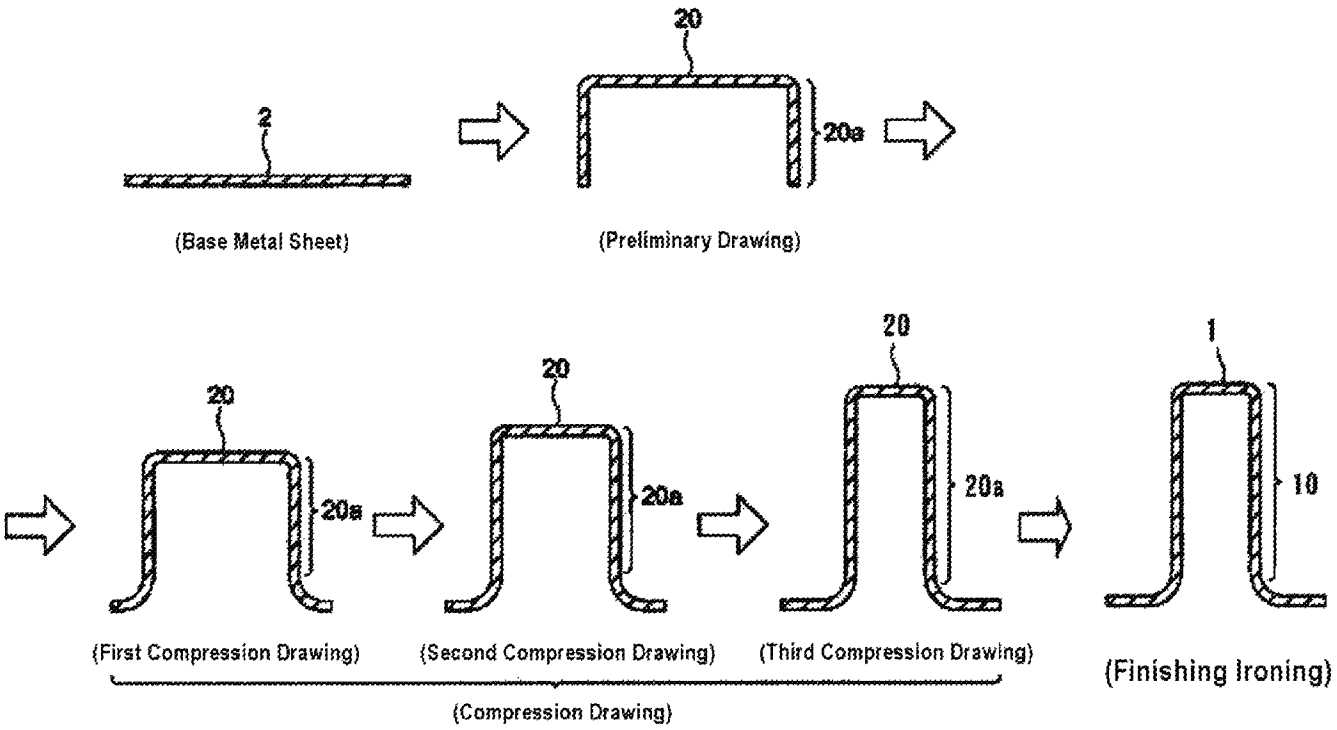

[FIG. 3]
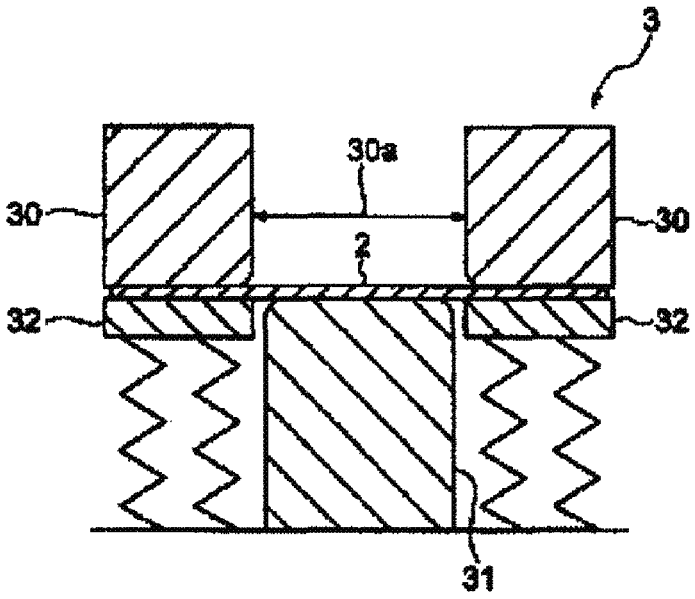

[FIG. 4]
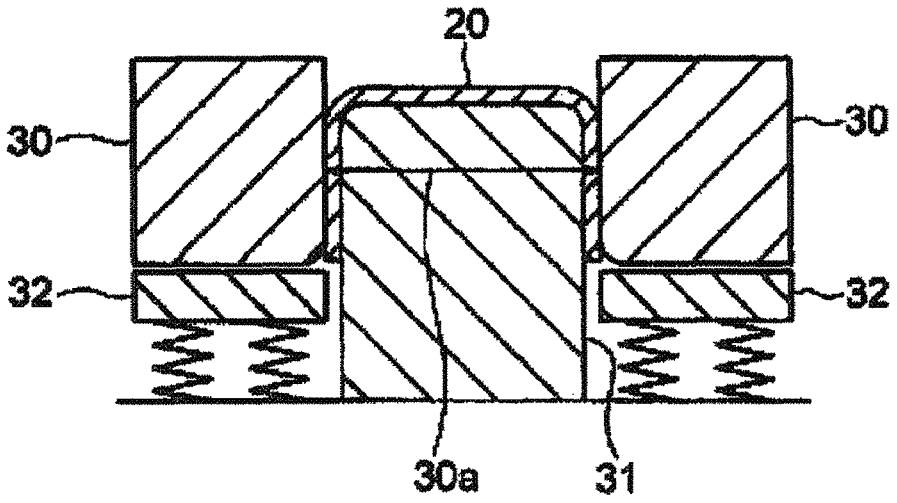

[FIG. 5]
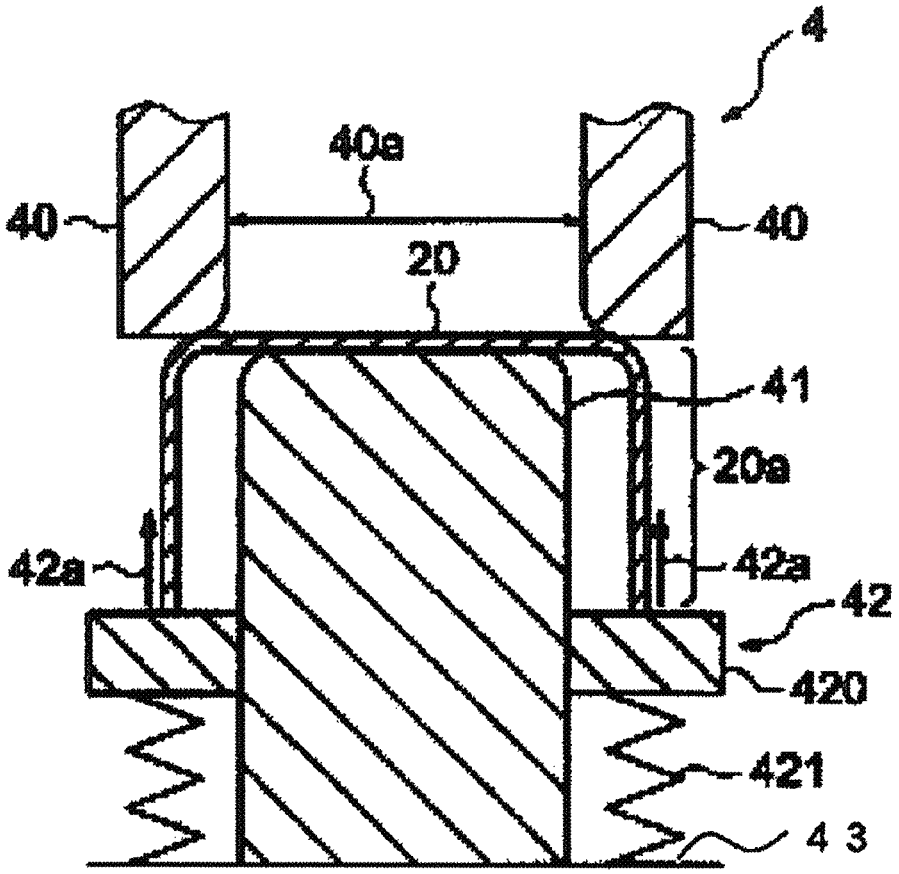

[FIG. 6]
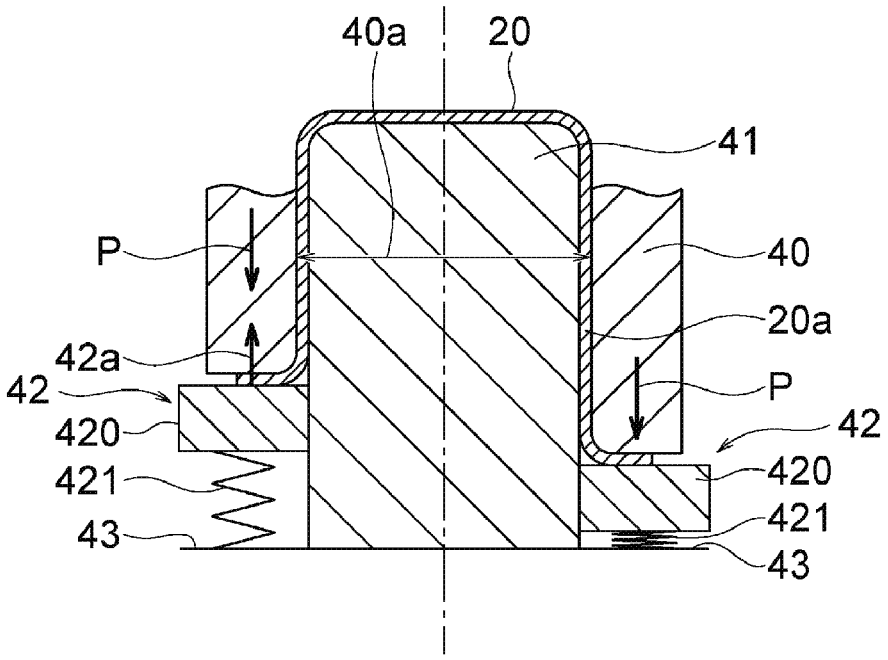

[FIG. 7]
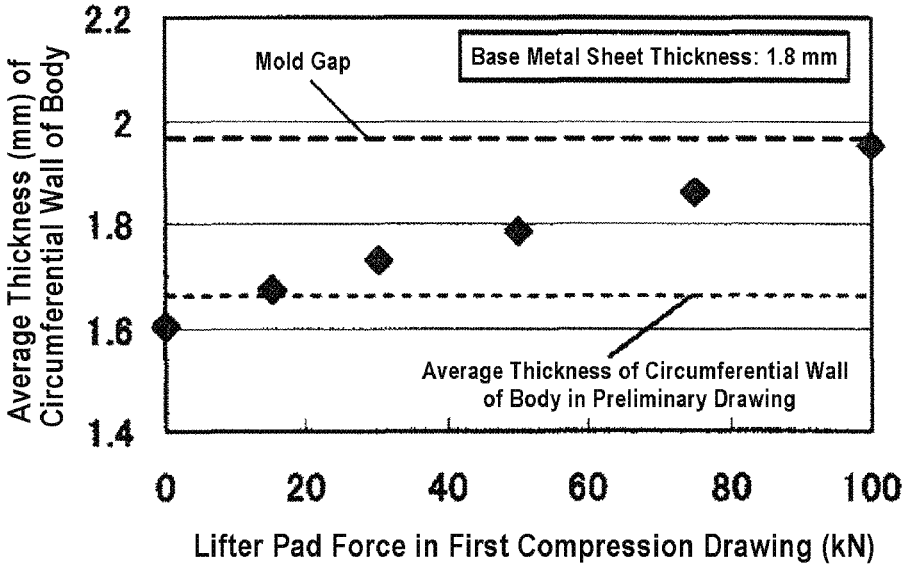

[FIG. 8]
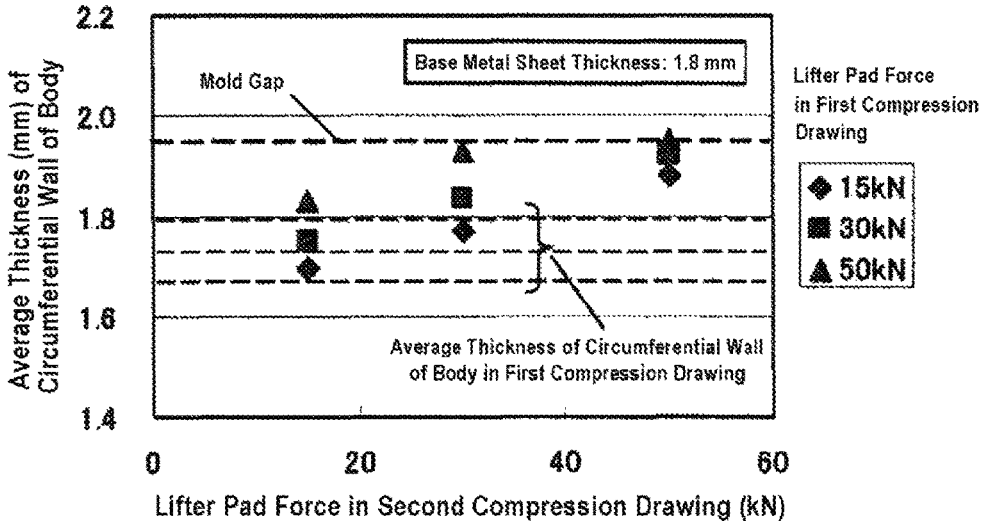

[FIG. 9]
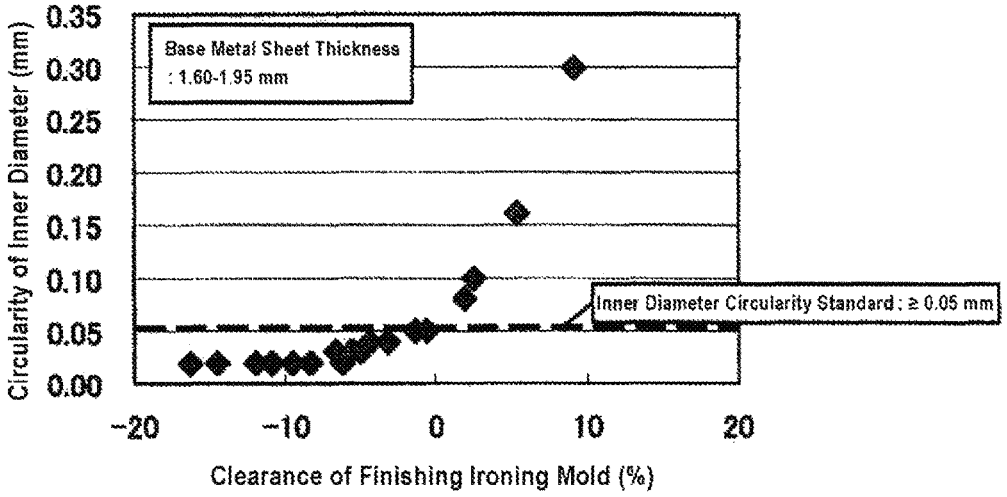

[FIG. 10]
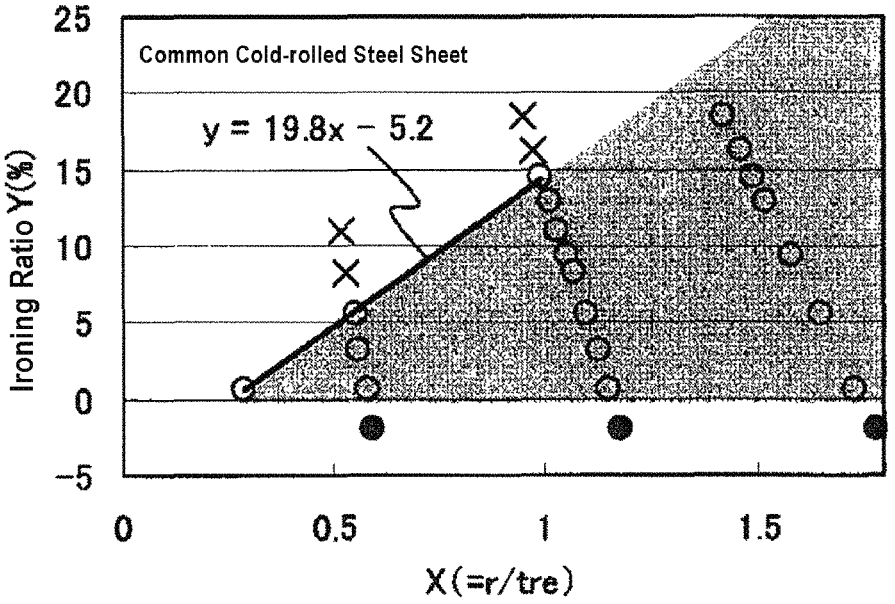

[FIG. 11]
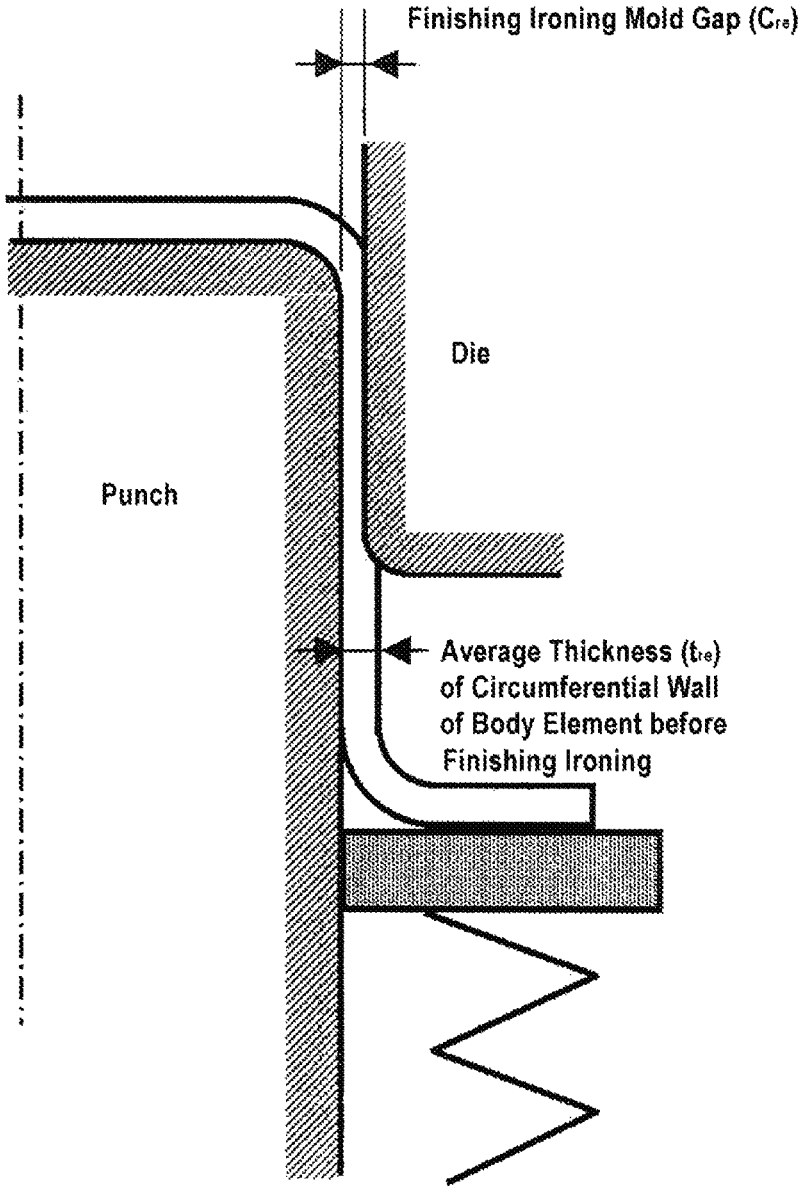

METHOD FOR MANUFACTURING MOLDED MEMBER

The present application is a U.S. National Stage of PCT International Patent Application No. PCT/JP2017/008362, filed Mar. 2, 2017, which claims priority to JP Application No. 2016-040551, filed Mar. 3, 2016, both of which are hereby incorporated herein by reference.

TECHNICAL FIELD

This invention relates to a method for manufacturing a molded member including a tubular body and a flange formed at an end portion of the body.

BACKGROUND ART

As disclosed, for example, in non-patent document 1 as described below, a molded member including a tubular body and a flange formed at an end portion of the body is manufactured by performing a drawing process. The drawing process forms the body by stretching a base metal sheet, so that a thickness of a circumferential wall of the body is generally lower than that of the base material sheet.

The molded member molded by the drawing process as described above may be used as a motor case disclosed, for example, in patent document 1 and the like as described below. In this case, the circumferential wall of the body is expected to function as a shielding material for preventing magnetic leakage to the outside of the motor case. Depending on motor structures, the circumferential wall is also expected to function as a back yoke of a stator.

The performance of the body as the shield material or back yoke is improved as the thickness of the body increases. Therefore, when a molded member is produced by the drawing process as described above, a base metal sheet with a thickness larger than the required thickness of the circumferential wall of the body is selected taking into account the reduction in thickness of the body. However, the thickness of the base metal sheet is not always constant, and varies within an allowable range of the thickness called tolerance of thickness. Further, due to change of a state of a mold or variations in material properties, an amount of thickness reduction in the drawing process may also vary.

On the other hand, in order to reduce the vibration and noise of the motor, highly accurate circularity of an inner diameter may be required for the inner diameter of the motor case. Therefore, typically, in a step after a multi-stage drawing process, a finishing ironing process is performed on the body to improve the circularity of the inner diameter. The finishing ironing process is carried out using two molds in which an interval (clearance) of a gap between the two molds is set to be less than the thickness of the material of the body, when the ironing is applied by sandwiching the material of the body from both the inner side and the outer side using the two molds. The setting of the clearance to be less than the thickness of the material of the body refers to minus clearance.

At this time, when the thickness of the base metal sheet is thinner than a predetermined thickness or the thickness reduction rate is increased due to variations in the material properties of the base metal sheet or a change of a mold state during the drawing step, the thickness of the body prior to the ironing process will be less than the predetermined thickness. As a result, an amount of the ironing process becomes insufficient for the ironing mold prepared beforehand, so that the accuracy of the circularity of the inner diameter may be decreased. Conversely, when the thickness of the base metal sheet is thicker than the predetermined thickness, or the material properties of the base metal sheet varies and the state of the die state changes during the drawing step, or the like, the thickness of the body prior to the finishing ironing process may be too thicker than the predetermined thickness. In such a case, although the circularity of the inner diameter after the finishing ironing process is satisfied, another problem is caused that the base metal sheet adheres or seizes to the finishing ironing die.

The thickness of the circumferential wall of the body before the finishing ironing process varies due to variations in the thickness of the base metal sheet or variations in the thickness reduction rate during the drawing process. However, the clearance of the mold for carrying out the finishing ironing process is fixed, so that even if the thickness of the circumferential wall of the body before the finishing ironing process varies, the variation cannot be absorbed by changing conditions of the drawing process, thereby causing the above problems.

The problems are thus caused even if the thickness of the circumferential wall of the body before the finishing ironing process is thin or thick. Therefore, there have been severe requirements for the tolerance of thickness of the base metal sheet to be subjected to the multi-stage drawing process.

Thus, Patent Document 2 and the like as described below disclose a mold for performing compression drawing in the multistage drawing process in order to prevent a decrease in the thickness of the body of the drawn member.

In the mold for the compression drawing, a tubular member molded in a previous step is fitted into a deformation preventing member provided on a lower mold in a state where an opening flange of the tubular member is placed downward, the opening flange is positioned onto a concave portion of a plate provided at the lower mold, and an outer periphery of the flange is engaged with the concave portion. An upper mold is then allowed to descend to press-fit a tubular portion of the tubular member into a hole of a die provided at the upper mold, whereby compressive force acts and the compression drawing process is carried out.

In this case, since the deformation preventing member can move upward and downward relative to the plate, a side wall of the tubular member is mostly not subjected to any tensile force, so that a decrease in the thickness is suppressed, and it is rather possible to increase the thickness (an increase in thickness).

It should be understood that the compressive force thus applied to the body element is equal to deformation resistance of the body element when press-fitted into the hole of the die. In other words, contributed to the increase in the thickness are mold clearance between the die and the punch, which is mainly relevant to the deformation resistance, a curvature radius of a shoulder portion of the die, and material strength (yield strength/cross sectional area) of the body element.

CITATION LIST

Non-Patent Literature

Non-patent Document 1: Masao Murakawa, et. al., "Basics of Plastic Processing", First Edition, SANGYO-TOSHO Publishing Co. Ltd., Jan. 16, 1990, pp. 104 to 107

Patent Literatures

Patent Document 1: Japanese Patent Application Publication No, 2013-51765 A

Patent Document 2: Japanese Utility Model Application Publication No. H04-43415 A Patent Document 3: Japanese Patent No. 5395301 B

SUMMARY OF INVENTION

Technical Problem

However, in the compression drawing method as descried above, the tubular member is placed on the plate fixed to the lower mold, and the tubular member is sandwiched between the dies and the plate which have descended from above. That is, since the thickness is increased by applying a compressive force to the tubular member in a so-called bottom-hitting state, it is possible to increase the thickness, but it is difficult to control the increase and decrease in the thickness by adjusting the compressive force in response to the variations of thickness of the base metal sheet.

The present invention has been made to solve the above problems. An object of the present invention is to provide a method for manufacturing a molded member, which can maintain high accuracy circularity of an inner diameter of a body by controlling an increase and decrease in a thickness of a base metal sheet to adjust a thickness of a circumferential wall of the body element before a finishing ironing process, even if the thickness of the base metal sheet varies or even if mold conditions varies.

A further object is to provide a method for manufacturing a molded member, which can prevent occurrence of adhesion, seizure or the like of the base metal sheet to the finishing ironing die by specifying clearance of a mold used for the finishing ironing process.

Solution to Problem

The present invention relates to a method for manufacturing a molded member by carrying out multi-stage drawing on a base metal sheet, the molded member comprising: a tubular body; and a flange formed at an end portion of the body, wherein the multi-stage drawing comprises: preliminary drawing for forming a preliminary body having a body element from the base metal sheet; at least one compression drawing performed after the preliminary drawing using a mold, the mold comprising: a die having a pushing hole; a punch for being inserted into the inside of the body element to push the body element into the pushing hole; and a compressing means for applying a compressive force along a depth direction of the body element to a circumferential wall of the body element, the at least one compression drawing forming the body by drawing the body element while applying the compressive force to the body element; and at least one finishing ironing performed after the at least one compression drawing; wherein the compressing means comprises a lifter pad, the lifter pad comprising: a pad portion which is disposed at an outer circumferential position of the punch so as to face the die, and on which a lower end of the circumferential wall of the body element is placed; and an urging portion, the urging portion being configured to support the pad portion from below and enable a supporting force for supporting the pad portion to be adjusted; wherein the at least one compression drawing is performed so as to be completed until the pad portion reaches a bottom dead center; and wherein the supporting force acts upon the body element as the compressive force when performing the compression drawing of the body element.

Advantageous Effects of Invention

According to the method for manufacturing the molded member of the present invention, the body is formed by adjusting the compressive force according to the thickness of the base metal sheet, and drawing the body element while applying the compressive force to the body element along the depth direction of the body element. Therefore, it is possible to prevent any insufficient ironing in the finish ironing and deterioration of the circularity of the inner diameter by increasing the compressive force, even if the thickness of the base metal sheet varies toward a thinner side than expected. Conversely, even if the thickness of the base metal sheet varies toward a thicker side than expected, by decreasing the compressive force it is possible to satisfy the circularity of the inner diameter and prevent occurrence of adhesion, seizure or the like of the base metal sheet to the finishing ironing die. As a result, a base metal sheet with wider tolerance of thickness than that of prior arts, so that procurement of materials is facilitated.

BRIEF DESCRIPTION OF DRAWINGS

FIG. 1 is a perspective view showing a molded member manufactured by a method for manufacturing a molded member according to Embodiment 1 of the present invention.

FIG. 2 is an explanatory view illustrating a method for manufacturing the molded member shown in FIG. 1.

FIG. 3 is an explanatory view showing a mold used for preliminary drawing in FIG. 2.

FIG. 4 is an explanatory view illustrating preliminary drawing with the mold shown in FIG. 3

FIG. 5 is an explanatory view illustrating a mold used in the first compression drawing shown in FIG. 2.

FIG. 6 is an explanatory view showing first compression drawing performed with the mold shown in FIG. 5 on the left side of the dotted line and a bottom-hitting state of a pad portion of a lifter pad on the right side of the dotted line as Comparative Example.

FIG. 7 is a graph showing a relationship between a lifter pad force and an average thickness of a circumferential wall of a body in a first compression drawing step.

FIG. 8 is a graph showing a relationship between a lifter pad force and an average thickness of a circumferential wall of a body in a second compression drawing step.

FIG. 9 is a graph showing a relationship between clearance of a mold in finish ironing and circularity of an inner diameter of a circumferential wall of a body after finishing ironing.

FIG. 10 is a graph showing a relationship between an ironing ratio Y and X ($=r/t_{re}$) in a common cold-rolled steel sheet.

FIG. 11 is an explanatory view showing a relationship between an average thickness $t_{re}$ of a circumferential wall of a body element before finishing ironing and mold clearance $c_{re}$ in finish ironing.

DESCRIPTION OF EMBODIMENTS

Embodiments of the present invention will be described below with reference to the drawings.

Embodiment 1

FIG. 1 is a perspective view showing a molded member 1 manufactured by a method for manufacturing a mold member according to Embodiment 1 of the present invention. As shown in FIG. 1, the molded member 1 manufactured by the method for manufacturing the molded member according to the present embodiment includes a body 10 and a flange 11. The body 10 is a tubular portion having a top wall 100 and a circumferential wall 101 that extends from an outer edge of the top wall 100. Depending on the orientation of the molded member 1 to be used, the top wall 100 may be referred to by other terms, such as a bottom wall. In FIG. 1, the body 10 is shown to have a perfectly circular sectional shape, but the body 10 may have another shape, for example, such as an elliptical sectional shape or angular tubular shape. The top wall 100 may be subjected to further processing. For example, a protrusion further projecting from the top wall 100 can be formed. The flange 11 is a sheet portion formed on an end portion (an end portion of the circumferential wall 101) of the body 10.

Next, FIG. 2 is an explanatory view illustrating the method for manufacturing the molded member 1 shown in FIG. 1. The method for manufacturing the molded member according to the present invention produces the molded member 1 by subjecting a flat base metal sheet 2 to multi-stage drawing and finishing ironing. The multi-stage drawing includes preliminary drawing and at least one compression drawing performed after the preliminary drawing. In the method for manufacturing the molded member according to this embodiment, three compression drawing processes (first to third compression drawing processes) are carried out. The base metal sheet 2 that can be used includes a metal sheet whose surface is not subjected to plating. More particularly, examples of the base metal sheet 2 that can be used include ferrous materials such as stainless steel sheets, common cold-rolled steel sheets, and common hot-rolled steel sheets, and nonferrous materials such as aluminum, and the like The preliminary drawing is a step of forming a preliminary body 20 including a body element 20*a* by processing the base metal sheet 2. The body element 20*a* is a tubular body having a larger diameter and a shallower depth than the body 10 shown in FIG. 1. The depth direction of the body element 20*a* is defined by an extending direction of the circumferential wall of the body element 20*a*. In the present embodiment, the entire preliminary body 20 constitutes the body element 20*a*. However, a preliminary body 20 including a flange may be formed. In this case, the flange does not constitute the body element 20*a*.

As will be described below in detail, the first to third compression processes are steps of forming the body 10 by drawing the body element 20*a* while a compressive force 42*a* (see FIG. 5) along the depth direction of the body element 20*a* to the body element 20*a*. The phrase "drawing the body element 20*a*" means reducing a diameter of the body element 20*a* and also increasing a depth of the body element 20*a*.

Next, FIG. 3 is an explanatory view illustrating a mold 3 used in the preliminary drawing shown in FIG. 2, and FIG. 4 is an explanatory view illustrating the preliminary drawing performed with the mold 3 shown in FIG. 3. As shown in FIG. 3, the mold 3 used in the preliminary drawing includes a die 30; a punch 31; and a cushion pad 32. The die 30 is provided with a pushing hole 30*a* into which the base metal sheet 2 is pushed together with the punch 31. The cushion pad 32 is disposed at an outer circumferential position of the punch 31 so as to face an outer end surface of the die 30. As shown in FIG. 4, in the preliminary drawing, an outer edge portion of the base metal sheet 2 is not completely constrained by the die 30 and the cushion pad 32, and the outer edge portion of the base metal sheet 2 is drawn out until it escapes from the constraint applied thereto by the die 30 and the cushion pad 32. The entire base metal sheet 2 may be pushed together with the punch 31 into the pushing hole 30*a* and drawn out. When forming the preliminary body 20 including the flange as described above, the outer edge portion of the base metal sheet 2 may be stopped at such a depth that it does not escape from the restraint applied thereto by the die 30 and the cushion pad 32.

Next, FIG. 5 is an explanatory view illustrating a mold 4 used in the first compression drawing in FIG. 2, and FIG. 6 is an explanatory view showing the first compression drawing by means of the mold 4 in FIG. 5. As shown in FIG. 5, the mold 4 used in the first compression drawing includes a die 40; a punch 41; and a lifter pad 42. The die 40 is a member having a pushing hole 40*a*. The punch 41 is a cylindrical body which is inserted into the inside of the body element 20*a* to push the body element 20*a* into the pushing hole 40*a*.

The lifter pad 42 is disposed at an outer circumferential position of the punch 41 so as to face the die 40. More particularly, the lifter pad 42 includes a pad portion 420 and an urging portion 421. The pad portion 420 is an annular member disposed at the outer circumferential position of the punch 41 so as to face the die 40. The urging portion 421 is disposed on a lower portion of the pad portion 420, and urges and supports the pad portion 420. On the pad portion 420, the body element 20*a* is placed. The circumferential wall of the body element 20*a* is sandwiched between the die 40 and the pad portion 420 when the die 40 descends. By thus sandwiching the circumferential wall of the body element 20*a* between the die 40 and the pad portion 420, an urging force (a lifter pad force) of the urging portion 421 is applied to the body element 20*a* as the compressive force 42*a* along the depth direction of the body element 20*a*. That is, the lifter pad 42 constitutes a pressurizing means for applying to the body element 20*a* the compressive force 42*a* along the depth direction of the body element 20*a*.

As shown on the left side of the dotted line in FIG. 6, in the first compression process, the die 40 descends, whereby the body element 20*a* is pushed into the pushing hole 40*a* together with the punch 41, so that the body element body 20*a* is drawn. In this case, after the circumferential wall of the body element 20*a* is sandwiched between the die 40 and the pad portion 420, the compressive force 42*a* along the depth direction of the body element 20*a* continues to be applied to the body element 20*a* by the pad portion 420. That is, in the first compressing process, the body element 20*a* is drawn while applying the compressive force 42*a*. As will be described below in detail, when the compressive force 42*a* satisfies a predetermined condition, the body element 20*a* can be drawn without causing a decrease in the thickness of the body element body 20*a*. As a result, the thickness of the body element 20*a* which has undergone the first compression drawing process is equal to or higher than the thickness of the body element 20*a* prior to the first compression drawing.

During the processing, the first compression drawing is performed without arriving of the pad portion 420 of the lifter pad 42 at a bottom dead center, that is, without bringing about a bottom-hitting state. At this time, the pad portion 420 is in a state where it is freely movable in the up and down direction. Then, a processing force P of the die 40 is applied downward to the pad portion 420, and a supporting force 42*a* of the urging portion 421 is also applied upward. The upward supporting force 42*a* acts as a compressive force on the body element 20*a* and works so as to push the body element 20*a* into an inner side of the pushing hole 40*a*, that is, between the die 40 and the punch 41. This provides an effect of increasing the thickness of the body element 20*a* in the first compression drawing.

Here, the processing force P of the die 40 refers to a downward force for allowing the die 40 to descend against deformation resistance of the body element 20*a* and the supporting force 42*a* of the urging portion 421. The processing force P of the die 40 is somewhat larger than the sum of the deformation resistance of the body element 20*a* and the supporting force 42*a* of the urging portion 421, that is, the upward force, the die 40 gradually descends while compression-drawing the body element 20*a*.

As shown on the right side of the dashed line in FIG. 6, when the pad portion 420 reaches the bottom dead center during the processing of the body element 20*a*, that is, when the pad portion 420 is in the bottom-hitting state, any upward supporting force of the urging portion 421 does not occur. Therefore, the supporting force of the urging portion 421 does not act as the compressive force on the body element 20*a* between the die 40 and the pad portion 420, so that the body element 20*a* is not subjected to the compression processing, but is in a state of being simply drawn. Therefore, if the pad portion 420 is thus in the bottom-hitting state before completion of the compression drawing of the body element 20*a*, the effect of increasing the thickness of the body element 20*a* cannot be obtained. Further, contributed to the effect of increasing the thickness are, in addition to the supporting force of the urging portion 421, mold clearance between the die 40 and the punch 41, which is mainly relevant to the deformation resistance, a curvature radius r of a shoulder portion of the die 40, and material strength (yield strength/cross sectional area) of the body element 20*a*. However, these conditions cannot be easily changed. Therefore, if the pad portion 420 is in the bottom-hitting state during the processing of the body portion body 20*a*, it will be difficult to control an increase and decrease in the thickness in response to the variation of the thickness of the base metal sheet.

The second compression drawing process and the third compression drawing process in FIG. 2 are performed using a mold having the same arrangement as that of the mold 4 shown in FIGS. 5 and 6. However, the dimensions of the die 40 and the punch 41 may be changed as needed. In the second compression drawing process, the body element 20*a* after the first compression drawing process is drawn while applying the compressing force 42*a*. Further, in the third compression drawing process, the body element 20*a* after the second compression drawing process is drawn while applying the compressing force 42*a*. These first to third compression drawing processes are carried out, and subsequent finishing ironing is then carried out, whereby the body 10 is formed from the body element 20*a*. Here, in the present invention, it is important to adjust the compression force in the first to third compression drawing processes such that the thickness of the body element 20*a* in the third compression drawing process corresponding to a pre-step of the finishing ironing is a predetermined thickness. As a result, in the finishing ironing, the processing is performed with appropriate mold clearance that satisfies the circularity of the inner diameter and does not cause adhesion, seizure of the like of the base metal sheet to the finishing ironing die.

EXAMPLES

Examples will be now illustrated. The present inventors investigated a relationship between magnitude of the lifter pad force during compression and an average sheet thickness (mm) of the circumferential wall of the body of the body element 20*a*, using, as the base metal sheet 2, round sheets each having a diameter of 116 mm, of SUS 304, SUS 430, a common cold-rolled steel sheet, a common hot-rolled steel sheet and an aluminum sheet (A 5052) each having a thickness of from 1.60 to 2.00 mm. Further, the present inventors investigated a relationship between clearance of the finishing ironing mold and the circularity of the inner diameter after the finishing ironing, using body elements 20*a* having various sheet thicknesses of the circumferential walls of the bodies prepared by changing the lifter pad force during the compression drawing process.

Furthermore, the present inventors investigated a range of the sheet thickness of each moldable base metal sheet in an ordinary thickness-decreasing process (Comparative Example 1) that does not apply any compressive force in the depth direction of the body element, and a bottom-hitting thickness-increasing process (Comparative Example 2) that is a conventional compression processing, and the lifter pad force controlled thickness-increasing process of the present invention. Moreover, the present inventors investigated a relationship between the curvature radius (mm) of the shoulder portion of the die and the ironing ratio in the finishing ironing process, on a moldable range which satisfies the circularity of the inner diameter after the finishing ironing and which does not cause adhesion, seizure or the like of the body element to the finishing ironing die.

The processing conditions are as follows. The results are shown in FIG. 7.

Curvature radius of shoulder portion of die: from 0.45 to 10 mm;

Diameter of Punch:
- Preliminary drawing 66 mm,
- First compression drawing 54 mm,
- Second compression drawing 43 mm,
- Third compression drawing 36 mm,
- Finish ironing 36 mm;

Mold clearance between die and punch (one side):
- Preliminary drawing 2.20 mm,
- First compression drawing 1.95 mm,
- Second compression drawing 1.95 mm,
- Third compression Drawing 1.95 mm,
- Finish ironing 1.55 mm;

Lifter pad force: from 0 to 100 kN; and

Press oil: TN-20N.

FIG. 7 is a graph showing the relationship between the lifter pad force and the average thickness of the circumferential wall of the body in the first compression drawing process, using the common cold-rolled steel sheet having a thickness of 1.8 mm as the base metal sheet. In FIG. 7, the vertical axis represents an average thickness of the circumferential wall of the body after the first compression drawing process, and the horizontal axis represents a first compression drawing lifter pad force (kN). It should be noted that the average thickness of the circumferential wall of the body is obtained by averaging the thickness of the circumferential wall from a R stop on the flange side of the shoulder portion of the punch 41 to a R stop on the top wall side of the shoulder portion of the die 40. It can be seen that the average thickness of the circumferential wall of the body increases almost linearly as the first compression lifter pad force increases. It can be also seen that a first compression lifter pad force of about 15 kN or more increases the thickness as compared with the average thickness of the circumferential wall of the body in the preliminary drawing.

FIG. 8 is a graph showing the relationship between the lifter pad force and the average thickness of the circumferential wall of the body in the second compression drawing process. Similarly to FIG. 7, the common cold-rolled steel sheet having a thickness of 1.8 mm was used as the base metal sheet. In FIG. 8, the vertical axis represents an average thickness of the circumferential wall of the body after the second compression drawing process, and the horizontal axis represents a second compression drawing lifter pad force (kN). As with the first compression drawing step, it can be seen that the average thickness of the circumferential wall of the body increases linearly as the second compression drawing lifter pad force increases. However, for the body element molded at the first compression drawing lifter pad force of 50 kN, the thickness was increased to almost the same thickness as the mold clearance at the second compression drawing lifter pad force of about 30 kN, and even if the lifter pad force was further increased, the thickness showed a constant value. These results mean that it is possible to increase the thickness of the body element to the substantially same thickness as the mold clearance by adjusting (increasing) the lifter pad force. In the second compression drawing process, it can be seen that a lifter pad force of about 10 kN or more increases the thickness as compared with the average thickness of the circumferential wall of the body in the first compression drawing process.

FIG. 9 is a graph showing the relationship between the mold clearance in the finishing ironing process and the circularity of the inner diameter of the circumferential wall of the body after the finishing ironing. Here, SUS 304, SUS 430, the common cold-rolled steel sheet, the common hot-rolled steel sheet and the aluminum plate (A5052) each having a sheet thickness of 1.60 to 1.95 mm were used as the base metal sheet. In FIG. 9, the vertical axis represents circularity (mm) of the inner diameter (mm) after the finishing ironing, and the horizontal axis represents clearance of the finishing ironing die. Here, the clearance of the finishing ironing die is as represented by the following equation (1):

$$Y(\%) = \frac{t_{re} - c_{re}}{c_{re}} \times 100 \quad (1)$$

in which:

$c_{re}$ represents clearance of the finishing ironing mold; and $t_{re}$ represents an average thickness of the circumferential wall of the body element before the finishing ironing.

It can be seen that as the clearance of the finishing ironing die increases, the circularity of the inner diameter drastically increases. It was also found that an inner diameter circularity standard of 0.05 mm or less can be realized by performing the ironing process in which the clearance of the finishing ironing die is in a minus region, in other words, the thickness of the body element is decreased.

Table 1 shows experimental results illustrating a thickness range of the moldable base metal sheet in the ordinary thickness-decreasing process (Comparative Example 1). Table 2 shows experimental results illustrating a thickness range of the moldable base metal sheet in the bottom-hitting thickness-increasing process (Comparative Example 2) which is the conventional thickness-increasing compression processing method. Table 3 shows experimental results illustrating a thickness range of the moldable base metal sheet in the lifter force controlled thickness-increasing process (Inventive Example). For all the experimental results, the common cold-rolled steel sheet was used as the base metal sheet. Further, each of these tables shows the thickness before finishing ironing and the clearance for the finishing ironing in relation to the thickness of the base metal sheet subjected to the experiment, and the circularity of the inner diameter of the circumferential wall of the body after the finishing ironing and occurrences of adhesion, seizure or the like of the base metal sheet to the finishing ironing die, and results evaluated from the circularity of the inner diameter and the occurrences of adhesion, seizure or the like of the base metal sheet to the finishing ironing die. It should be noted that only Table 3 regarding the lifter force controlled thickness-increasing process (Inventive Example) shows the presence or absence of the application of the lifter pad force during the first compression drawing as a reference.

TABLE 1

Ordinary Thickness-decreasing Process (Comparetive Example 1)

| Thickness (mm) of Base Metal Sheet | Thickness (mm) before Finishing Ironing | Clearance (%) in Finishing Ironing | Circularity (mm) | Adhesion Seizure | Evaluation |
|---|---|---|---|---|---|
| 1.60 | 1.42 | 9.2 | 0.30 | Not generated | X |
| 1.65 | 1.47 | 5.4 | 0.16 | Not generated | X |
| 1.70 | 1.51 | 2.6 | 0.10 | Not generated | X |
| 1.75 | 1.56 | −0.6 | 0.05 | Not generated | ○ |
| 1.80 | 1.60 | −3.1 | 0.04 | Not generated | ○ |
| 1.85 | 1.64 | −5.5 | 0.03 | Not generated | ○ |
| 1.90 | 1.69 | −8.3 | 0.02 | Not generated | ○ |
| 1.95 | 1.74 | −10.9 | 0.02 | Not generated | ○ |
| 2.00 | 1.79 | −13.4 | 0.02 | Not generated | ○ |

* Radius of finishing ironing dies shoulder: 1.8 mm

TABLE 2

| Bottom-hitting Thickness-increasing Process (Comparetive Example 2) | | | | | |
|---|---|---|---|---|---|
| Thickness (mm) of Base Metal Sheet | Thickness (mm) before Finishing Ironing | Clearance (%) in Finishing Ironing | Circularity (mm) | Adhesion Seizure | Evaluation |
| 1.60 | 1.52 | 2.0 | 0.08 | Not generated | X |
| 1.65 | 1.57 | −1.3 | 0.05 | Not generated | ○ |
| 1.70 | 1.62 | −4.3 | 0.04 | Not generated | ○ |
| 1.75 | 1.66 | −6.6 | 0.03 | Not generated | ○ |
| 1.80 | 1.71 | −9.4 | 0.02 | Not generated | ○ |
| 1.85 | 1.76 | −11.9 | 0.02 | Not generated | ○ |
| 1.90 | 1.81 | −14.4 | 0.02 | Not generated | ○ |
| 1.95 | 1.85 | −16.2 | 0.02 | Generated | X |
| 2.00 | 1.90 | −18.4 | 0.02 | Generated | X |

* Radius of finishing ironing dies shoulder: 1.8 mm

TABLE 3

| Lifter Force Controlled Thickness-increasing Process (Inventive Example) | | | | | | |
|---|---|---|---|---|---|---|
| Thickness (mm) of Base Metal Sheet | Thickness (mm) before Finishing Ironing | Clearance (%) in Finishing Ironing | Circularity (mm) | Adhesion Seizure | Evaluation | Lifter Pad Force |
| 1.60 | 1.65 | −6.1 | 0.03 | Not generated | ○ | Applied |
| 1.65 | 1.63 | −4.9 | 0.03 | Not generated | ○ | Applied |
| 1.70 | 1.63 | −4.9 | 0.03 | Not generated | ○ | Applied |
| 1.75 | 1.63 | −4.9 | 0.04 | Not generated | ○ | Applied |
| 1.80 | 1.60 | −3.1 | 0.03 | Not generated | ○ | Not applied |
| 1.85 | 1.64 | −5.5 | 0.02 | Not generated | ○ | Not applied |
| 1.90 | 1.69 | −8.3 | 0.02 | Not generated | ○ | Not applied |
| 1.95 | 1.74 | −10.9 | 0.02 | Not generated | ○ | Not applied |
| 2.00 | 1.79 | −13.4 | 0.02 | Not generated | ○ | Not applied |

* Radius of finishing ironing dies shoulder: 1.8 mm

In the ordinary thickness-decreasing process of Comparative Example 1 shown in Table 1, no compressive force was applied to the body element, so that each sheet thickness before the finish ironing was decreased without depending on the sheet thickness of each base metal sheet.

Since the clearance in the finishing ironing process is in a plus region when the sheet thickness of the base metal sheet is from 1.60 to 1.70 mm, it was not ironing processing and the circularity of the inner diameter exceeded the standard 0.05 mm. Also, the clearance in the finishing ironing process was −13.4% when the sheet thickness of the base metal sheet was 2.00 mm, and the circularity of the inner diameter after the finishing ironing was satisfied. It was also found that adhesion, seizure or the like of the base metal sheet to the die did not occur in the finishing ironing process. These results showed that the sheet thickness of the moldable base metal sheet in the ordinary thickness-decreasing process (Comparative Example 1) was in a range of from 1.75 mm to 2.00 mm, and its width was 0.25 mm.

In the bottom-hitting thickness-increasing process of Comparative Example 2 shown in Table 2, the compressive force was applied to the body element, so that each sheet thickness before finish ironing was decreased without depending on the sheet thickness of the base metal sheet. However, when compared with Comparative Example 1 (the ordinary thickness-decreasing process), the degree of decreased thickness was smaller.

For only the base metal sheet having a thickness of 1.60 mm, the circularity of the inner diameter exceeded the standard 0.05 mm. Further, when the thickness of the base metal sheet was 1.95 mm or more, it was found that adhesion, seizure or the like of the base metal sheet to the die occurred in the finishing ironing process.

These results showed that the sheet thickness of the moldable base metal sheet in the bottom-hitting thickness-increasing process (Comparative Example 2) was from 1.65 mm to 1.90 mm, and its width was 0.25 mm. It can be seen that although the thickness of the moldable base metal sheet is lower than that of the ordinary thickness-decreasing process of Comparative Example 1, its width does not change.

This means that a molding margin in the case where the sheet thickness of the base metal sheet varies is the same for both the ordinary thickness-decreasing process (Comparative Example 1) and the bottom-hitting thickness-increasing process (Comparative Example 2).

In the lifter pad force controlled thickness-increasing process of Inventive Example shown in Table 3, the compressive force applied to the body element can be freely controlled by the lifter pad force according to the thickness of the base metal sheet, so that it is possible to decrease a variation range of the thickness before the finishing ironing process. For example, as shown in Table 3, when the thickness of the base metal sheet was thin, i.e., from 1.60 mm to 1.75 mm, the lifter pad force was applied during the first compression drawing process to increase the thickness, and when the sheet thickness of the base metal sheet was thick, i.e., 1.80 mm or more, the thickness was decreased without applying the lifter pad force and the compression drawing was performed, so that it was possible to reduce the variation range of the thickness before the finishing ironing. Here, the condition that the lifter pad force is not applied corresponds to the ordinary thickness-decreasing process of Comparative Example 1, and even when the thickness of the base metal sheet was 2.00 mm, adhesion, seizure or the like of the base metal sheet to the die did not occur, and the circularity after the finishing ironing satisfied the standard 0.05 mm or less for all the sheet thicknesses of the base metal sheets. These results showed that the thickness of the moldable base metal sheet in the lifter pad force controlled thickness-increasing process (the present invention) was in a range of from 1.60 mm to 2.00 mm, and its width was 0.40 mm. This means that the lifter pad force controlled thickness-increasing process of Inventive Example has a broader molding margin in the case where the sheet thickness of the base metal sheet varies, than the molding margin in the ordinary thickness-decreasing process (Comparative Example 1) or the bottom-hitting thickness-increasing processing (Comparative Example 2). That is, it is understood that the method for manufacturing the molded member according to the present invention has a wider thickness range of the moldable base metal sheet, than that of the ordinary thickness-decreasing process of Comparative Example 1 or the bottom-hitting thickness-increasing process of Comparative Example 2 which is the conventional thickness-increasing compression processing method.

FIG. 10 is a graph showing the relationship between the ironing ratio Y and X ($=r/t_{re}$) when the common cold-rolled steel is used as the base metal sheet. In FIG. 10, the vertical axis represents the ironing ratio Y and the horizontal axis represents a ratio X of the curvature radius r of the shoulder portion of the die of the finishing ironing mold to the average thickness $t_{re}$ of the circumferential wall of the body element before the finishing ironing. Here, the definition of the ironing ratio Y is as described above.

In the figure, the symbol "O" (white circle mark) indicates an evaluation that it was possible to suppress occurrence of adhesion, seizure or the like of the base metal sheet to the finishing ironing die, and the symbol "x" (x-shaped mark) indicates an evaluation that it was not possible to suppress the occurrence of adhesion, seizure or the like of the base metal sheet to the finishing ironing die. Further, the symbol "●" (black circle mark) indicates that the circularity of the inner diameter exceeds 0.05 mm. As shown in FIG. 10, for the common cold-rolled steel sheet, it was confirmed that the occurrence of adhesion, seizure of the like of the base metal sheet to the finishing ironing die can be suppressed in the region below the straight line represented by Y=19.8X−5.2.

That is, it was confirmed that by determining the average thickness $t_{re}$ of the circumferential wall of the body element before the finishing ironing so as to satisfy the below equation (2) in the lifter pad force controlled thickness-increasing process, the occurrence of adhesion, seizure or the like of the base metal sheet to the finishing ironing die could be suppressed. In the following conditional equation (Equation (2)), the reason why 0<Y is defined is that when the ironing ratio Y is 0% or less, the ironing is not performed.

$$0<Y\leq 19.8X-5.2 \quad (2)$$

The same experiments were carried out for the materials of the stainless steel sheets SUS 304 and SUS 430, as well as the materials of the common hot-rolled steel sheet and the aluminum sheet (A 5052), as the base metal sheet. As a result, when the ironing ratio exceeded Y=19.8X−5.2 in the finishing ironing step, the occurrence of adhesion, seizure or the like of the base metal sheet to the die could not be suppressed, although there was the largeness/smallness of the degrees of the occurrence. Similarly, it was confirmed that when the ironing ratio was 0% or less, the circularity of the inner diameter exceeded 0.05 mm.

According to the method for manufacturing the molded member, the body is formed by drawing the body element while applying the compressive force in accordance with the thickness of the base metal sheet to the body element along the depth direction of the body element. Therefore, even if the thickness of the base metal sheet shifts to a thinner side, the lifter pad force is increased, whereby it is possible to prevent insufficient ironing in the finishing ironing process and deterioration of internal accuracy. Conversely, even if the thickness of the base metal sheet shifts to a thicker side, the lifter pad force was decreased, whereby the occurrence of adhesion, seizing or the like of the base metal sheet to the finishing ironing die can be prevented while satisfying the circularity. As a result, a material metal sheet with wider tolerance of thickness than that of the prior arts can be used, thereby facilitating procurement of materials.

This configuration is particularly useful in applications for which highly accurate circularity of an inner diameter of a molded member is required, such as motor cases.

Further, the lifter pad 42 which does not bring about the bottom-hitting state during the processing constitutes the pressurizing means, so that the body element 20*a* can be more reliably drawn while applying the compressing force 42*a* to the body element 20*a* along the depth direction of the body element 20*a*.

The lifter pad force in the compression drawing process can be adjusted according to the sheet thickness of the base metal sheet, so that the average thickness of the circumferential wall of the body element before the finishing ironing can be fitted within an appropriate thickness range, irrespective of the sheet thickness of the base metal sheet, and stable ironing processing can always be performed with constant clearance in the ironing process.

Further, the method for manufacturing the molded member according to the present invention satisfies the equation (2) in which Y is the ironing ratio, and X is a ratio of the curvature radius r of the shoulder portion of the die of the finishing ironing mold to the average thickness $t_{re}$ of the circumferential wall of the body element before the finishing ironing, so that the circularity of the inner diameter after the finishing ironing can be satisfied, and the body element 20*a* can be drawn without causing adhesion, seizure or the like of the base metal sheet to the finishing ironing die:

$$0<Y\leq 19.8X-5.2 \quad (2)$$

Further, although the present embodiment illustrates that the three compression processes are performed, the number of the compression processes may be changed, as needed, according to the size and required dimensional accuracy of the molded member 1.

DESCRIPTION OF REFERENCE NUMERALS

1 molded member
10 body
100 top wall
101 circumferential wall
11 flange
2 base metal sheet
20 preliminary body
20*a* body element
4 mold
40 die
40*a* pushing hole
41 punch
42 lifter pad
42*a* compressive force
421 urging portion
43 punch holder

What is claimed is:

1. A method for manufacturing a molded member by carrying out multi-stage drawing on a base metal sheet, the molded member comprising: a tubular body; and a flange formed at an end portion of the tubular body, wherein the multi-stage drawing comprises:

preliminary drawing for forming a preliminary body having a body element from the base metal sheet;

at least one compression drawing performed after the preliminary drawing using a mold, the mold comprising: a die having a pushing hole; a punch for being inserted into the inside of the body element to push the body element into the pushing hole; and a compressing device that applies a compressive force along a depth direction of the body element to a circumferential wall of the body element, the at least one compression drawing forming the tubular body by drawing the body element while applying the compressive force to the body element; and at least one finishing ironing performed after the at least one compression drawing;

wherein the compressing device comprises a lifter pad, the lifter pad comprising: a pad portion which is disposed at an outer circumferential position of the punch so as to face the die, and on which a lower end of the circumferential wall of the body element is placed; and an urging portion, the urging portion being configured to support the pad portion from below and enable a supporting force for supporting the pad portion to be adjusted;

wherein the at least one compression drawing is performed without the pad portion machos arriving at a bottom dead center;

wherein the supporting force acts upon the body element as the compressive force when performing the compression drawing of the body element; and wherein in the at least one finishing ironing process, an ironing ratio Y is defined by the following equation:

$$Y(\%) = \frac{t_{re} - c_{re}}{c_{re}} \times 100$$

in which:

$c_{re}$ represents clearance of a mold used for the finishing ironing; and $t_{re}$ represents an average thickness of the circumferential wall of the body element before the finishing ironing; and a ratio X of a curvature radius r of a shoulder portion of a die of the mold used for the finishing ironing to the average thickness $t_{re}$ of the circumferential wall of the body element before the finishing ironing is defined as:

$X=r/t_{re}$; and wherein the ironing ratio Y is determined so as to satisfy the following equation with respect to the ratio X:

$0<Y\leq 19.8X-5.2$

2. The method for manufacturing the molded member according to claim 1, wherein the base metal sheet is a metal sheet whose surface is not subjected to plating.

3. A method for manufacturing a molded member by carrying out multi-stage drawing on a base metal sheet, the molded member comprising: a tubular body; and a flange formed at an end portion of the tubular body, wherein the multi-stage drawing comprises:

preliminary drawing for forming a preliminary body having a body element from the base metal sheet;

at least one compression drawing performed after the preliminary drawing using a mold, the mold comprising: a die having a pushing hole; a punch for being inserted into the inside of the body element to push the body element into the pushing hole; and a compressing device that applies a compressive force along a depth direction of the body element to a circumferential wall of the body element, the at least one compression drawing forming the tubular body by drawing the body element while applying the compressive force to the body element; and at least one finishing ironing performed after the at least one compression drawing;

wherein the compressing device comprises a lifter pad, the lifter pad comprising: a pad portion which is disposed at an outer circumferential position of the punch so as to face the die, and on which a lower end of the circumferential wall of the body element is placed; and an urging portion, the urging portion being configured to support the pad portion from below and enable a supporting force for supporting the pad portion to be adjusted;

wherein the at least one compression drawing is performed without the pad portion arriving at a bottom dead center;

wherein the supporting force acts upon the body element as the compressive force when performing the compression drawing of the body element; and wherein the at least one compression drawing adjusts an average thickness of the circumferential wall of the body element before the finishing ironing so that an ironing ratio in the finishing ironing is in a predetermined range by adjusting the supporting force for supporting the pad portion according to the thickness of the base metal sheet.

4. The method for manufacturing the molded member according to claim 3, wherein the base metal sheet is a metal sheet whose surface is not subjected to plating.

* * * * *